US011767158B2

(12) United States Patent
Weissbrod

(10) Patent No.: US 11,767,158 B2
(45) Date of Patent: Sep. 26, 2023

(54) BULK FLUX BAG HYBRID LINER BAG

(71) Applicant: Lincoln Global, Inc., Santa Fe Springs, CA (US)

(72) Inventor: Paul A. Weissbrod, South Euclid, OH (US)

(73) Assignee: LINCOLN GLOBAL, INC., Santa Fe Springs, CA (US)

( * ) Notice: Subject to any disclaimer, the term of this patent is extended or adjusted under 35 U.S.C. 154(b) by 567 days.

(21) Appl. No.: 16/909,108

(22) Filed: Jun. 23, 2020

(65) Prior Publication Data

US 2021/0047108 A1 Feb. 18, 2021

Related U.S. Application Data

(60) Provisional application No. 63/000,542, filed on Mar. 27, 2020, provisional application No. 62/888,170, filed on Aug. 16, 2019.

(51) Int. Cl.
*B65D 88/16* (2006.01)
*B65D 65/42* (2006.01)

(52) U.S. Cl.
CPC ..... *B65D 88/1618* (2013.01); *B65D 65/42* (2013.01)

(58) Field of Classification Search
CPC .... B65D 88/1618; B65D 31/02; B65D 31/16; B65D 88/1631; B65D 88/524; B65D 90/046
See application file for complete search history.

(56) References Cited

U.S. PATENT DOCUMENTS

| | | | |
|---|---|---|---|
| 5,437,507 | A | 8/1995 | Blumenkron |
| 5,468,528 | A | 11/1995 | Schnaars et al. |
| 2006/0280390 | A1 | 12/2006 | Richardson, Jr. et al. |
| 2016/0355331 | A1 | 12/2016 | Tavsanli et al. |
| 2018/0126661 | A1* | 5/2018 | Dunlap ..... B29C 66/83221 |

FOREIGN PATENT DOCUMENTS

| | | | |
|---|---|---|---|
| AU | 2014200708 | A1 | 8/2014 |
| DE | 92 15 563 | U1 | 1/1993 |
| DE | 20 2019 101643 | U1 | 5/2019 |
| FR | 2 634 468 | A1 | 1/1990 |

(Continued)

OTHER PUBLICATIONS

Dilworth; "Bulk Bag Basics—Not Everything is as it Seams;" http://www.minibulk.com/en/blog/bulk-bag-basics-keeping-your-fine-material-in-fine-shape-reinforced-seams; Dated Jan. 20, 2017; pp. 1-6.

(Continued)

*Primary Examiner* — George R Koch
*Assistant Examiner* — Christopher C Caillouet
(74) *Attorney, Agent, or Firm* — David J. Muzilla

(57) ABSTRACT

A liner bag for, for example, a flexible intermediate bulk container (FIBC) includes a body portion formed by at least two sheets. The body portion has a first end and a second end defining a cavity therebetween. The first end has an opening for receiving a product. The liner bag also includes at least one seal (e.g., a vertical seal) joining the two sheets. The liner bag further includes at least one polymer flange secured to the two sheets and extending outward from the vertical seal to provide at least one fastening location to secure the liner bag to the container.

16 Claims, 8 Drawing Sheets

(56) References Cited

FOREIGN PATENT DOCUMENTS

| | | | |
|---|---|---|---|
| GB | 2 092 990 | A | 8/1982 |
| GB | 2 301 087 | A | 11/1996 |
| KR | 10-1475465 | B1 | 12/2014 |
| KR | 10-1491820 | B1 | 2/2015 |
| WO | 96/09235 | A1 | 3/1996 |

OTHER PUBLICATIONS

Extended European Search Report from Corresponding Application No. EP20191383.7; dated Dec. 7, 2020; pp. 1-8.

* cited by examiner

BULK FLUX BAG HYBRID LINER BAG

CROSS-REFERENCE TO RELATED APPLICATIONS

This application relates to U.S. Provisional Patent Application Ser. No. 62/888,170, entitled BULK FLUX BAG HYBRID LINER BAG, filed Aug. 16, 2019, which is incorporated herein by reference in its entirety, and U.S. Provisional Patent Application Ser. No. 63/000,542, entitled BULK FLUX BAG HYBRID LINER BAG, filed Mar. 27, 2020, which is incorporated herein by reference in its entirety.

TECHNICAL FIELD

Embodiments of the present invention relate to bulk flux bags and liners of bulk flux bags for welding consumables.

BACKGROUND

Standard polyethylene or polypropylene film liner bags for a flexible intermediate bulk container (i.e., a "FIBC") are frequently manufactured with extended flanges along the vertical heat-seal seams for incorporation in the sewn vertical seams of the FIBC. This is done to ensure that the liner bag remains securely connected to the bag through the entire discharge of product. As foil laminate liner bags are being introduced for moisture control, the characteristics of foil laminate make the bag very susceptible to tearing from any puncture breach of the laminate. Sewing through the extended vertical flanges causes a line of needle punctures, which leads to tearing of the foil laminate liner bag in use. To prevent tearing, current solutions include the elaborate application of bi-directional reinforcing tape, which is very labor intensive to apply.

SUMMARY

The following summary presents a simplified summary in order to provide a basic understanding of some aspects of the (devices, systems and/or methods) discussed herein. This summary is not an extensive overview of the (devices, systems and/or methods) discussed herein. It is not intended to identify critical elements or to delineate the scope of such (devices, systems and/or methods). Its sole purpose is to present some concepts in a simplified form as a prelude to the more detailed description that is presented later.

One embodiment is a liner bag for a container. The container may be a FIBC, for example. The liner bag includes a body portion formed by at least two sheets. The body portion has a first end and a second end defining a cavity therebetween. The first end has an opening for receiving a product. The second end may be closed. The liner bag also includes at least one seal (e.g., a vertical seal) joining the two sheets. The liner bag further includes at least one polymer flange secured to the two sheets and extending outward from the vertical seal to provide at least one fastening location to secure the liner bag to the container. In one embodiment, the polymer flange is secured between the two sheets. In at least one embodiment, the polymer flange is secured on top of or below the two sheets. In one embodiment, the vertical seal extends from the first end to the second end to join the two sheets. In one embodiment, the liner bag includes four sheets, and a shape of the liner bag is substantially rectangular. In another embodiment, the shape of the liner bag is substantially circular. In a further embodiment, the shape of the liner bag is substantially polygonal. In one embodiment, the liner bag is configured to fit into an interior of the container to line the container. In one embodiment, the polymer flange is made of polyethylene or polypropylene material configured to resist tearing when secured to the container. In one embodiment, the liner bag includes four sheets where two sheets of the four sheets are each configured to be folded along a centerline and secured to the other two sheets of the four sheets to create a collapsible liner bag. In one embodiment, two sheets of the liner bag and the polymer flange are configured to be joined via an adhesive or via heat sealing. In one embodiment, the polymer flange is integral to at least one of the sheets of the liner bag. In one embodiment, a sheet of the liner bag is a foil laminate sheet having a foil element and a polymer element. In one embodiment, the polymer element is applied as a coating onto the foil element. In another embodiment, a portion of the polymer element extends beyond an edge of the foil element to create the polymer flange.

One embodiment is a method for creating and securing a liner bag to a container. The container may be a FIBC, for example. The method includes joining at least two sheets of foil laminate to form a liner bag for a container. Each of the two sheets of foil laminate are comprised of a foil element and a polymer element. The two sheets of foil laminate have at least one polymer flange extending outward from the two sheets of foil laminate. The method also includes sewing the liner bag to the container through the polymer flange. In one embodiment, the method includes forming the polymer flange by extending a portion of the polymer element beyond an edge of the foil element. In another embodiment, the method includes coating the polymer element onto the foil element. In one embodiment, the method includes joining the polymer flange to the two sheets of foil laminate via at least one of heat sealing or applying an adhesive.

These and other aspects of embodiments of the present invention will be evident when viewed in light of the drawings, detailed description, and appended claims.

BRIEF DESCRIPTION OF THE DRAWINGS

The accompanying drawings, which are incorporated in and constitute a part of the specification, illustrate various embodiments of the disclosure. It will be appreciated that the illustrated element boundaries (e.g., boxes, groups of boxes, or other shapes) in the figures represent one embodiment of boundaries. In some embodiments, one element may be designed as multiple elements or multiple elements may be designed as one element. In some embodiments, an element shown as an internal component of another element may be implemented as an external component and vice versa. Furthermore, elements may not be drawn to scale.

DETAILED DESCRIPTION OF THE INVENTION

Figure 1:
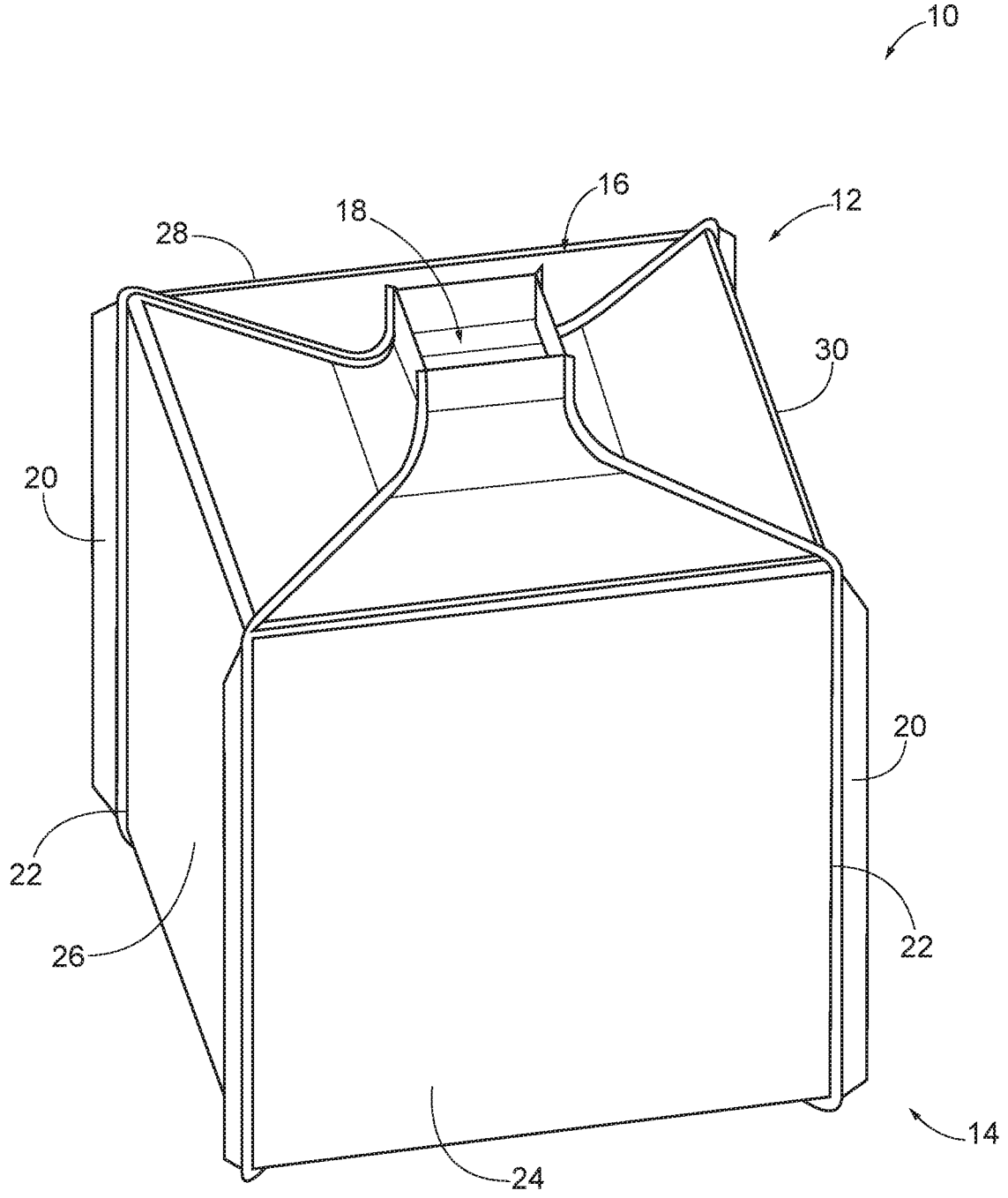
FIG. 1 illustrates an exemplary, non-limiting embodiment of a liner bag.

Embodiments of systems and methods to prevent tearing of a flexible intermediate bulk container, and of the liner of such containers, are disclosed. In one embodiment, a strip of material (e.g., polyethylene, polypropylene, etc.) is inserted between two foil laminate sheets to serve as an extended flange when making a heat sealed vertical seam. In another embodiment, foil laminate sheets are manufactured to include an extended flange that is formed by a polymer portion of the foil laminate sheet that extends beyond a foil portion of the foil laminate sheet. The flange becomes a sewn anchor point when affixing the liner to a FIBC. The tear-resistant properties of the flange are well understood, and permit the elimination of tape reinforcement of a flange formed by the laminate material. This provides advancement over the current technology by permitting the use of optimal poly film materials in the extended sewn-in flanges of the liner bag while using foil laminate film in the liner bag body for improved product protection.

Various embodiments will now be described with reference to the drawings, wherein like reference numerals are used to refer to like elements throughout. In the following description, for purposes of explanation, numerous specific details are set forth in order to provide a thorough understanding of the embodiments. It may be evident, however, that features described herein can be practiced without these specific details. Additionally, other embodiments are possible and the features described herein are capable of being practiced and carried out in ways other than as described. The terminology and phraseology used herein is employed for the purpose of promoting an understanding of the invention and should not be taken as limiting.

Turning to FIG. 1, a liner bag 10 is shown. The liner bag 10 may be incorporated into a FIBC (not shown) used to package a product (e.g., flux, etc.). Liner bag 10 may have a first end 12 and a second end 14. The first end 12 may include an opening 16 that extends into a hollow cavity 18 of the liner bag 10 where a product may be stored. The second end 14 may be sealed or otherwise closed, to retain the product within the liner bag 10. The liner bag 10 may include flanges 20 extending from vertical seals 22 of the liner bag 10. Vertical seals 22 may extend from the first end 12 to the second end 14 of liner bag 10 to join one or more sheets 24, 26, 28, 30 of the liner bag 10.

In an embodiment, the liner bag 10 has four sheets and is substantially rectangular in shape. The liner bag 10 may be similar in size and shape of a FIBC so that the liner bag 10 fits into the interior of a FIBC. In another embodiment, the liner bag 10 may be substantially circular in shape. In yet another embodiment, the liner bag 10 may be substantially polygonal in shape. It is to be recognized that the liner bag 10 may be any shape, size, and may be formed using any number of sheets. The liner bag 10 of any of the embodiments described herein may correspond to the shape and size of a respective FIBC for storing a product such as flux.

In an embodiment, the sheets of the liner bag 10 are formed from a foil laminate to control moisture that may form within a FIBC. The foil laminate may include a foil element and a polymer element. Flanges 20 may be formed from a polyethylene or polypropylene material that resists tearing when securing the liner bag 10 to a FIBC.

Figure 2:
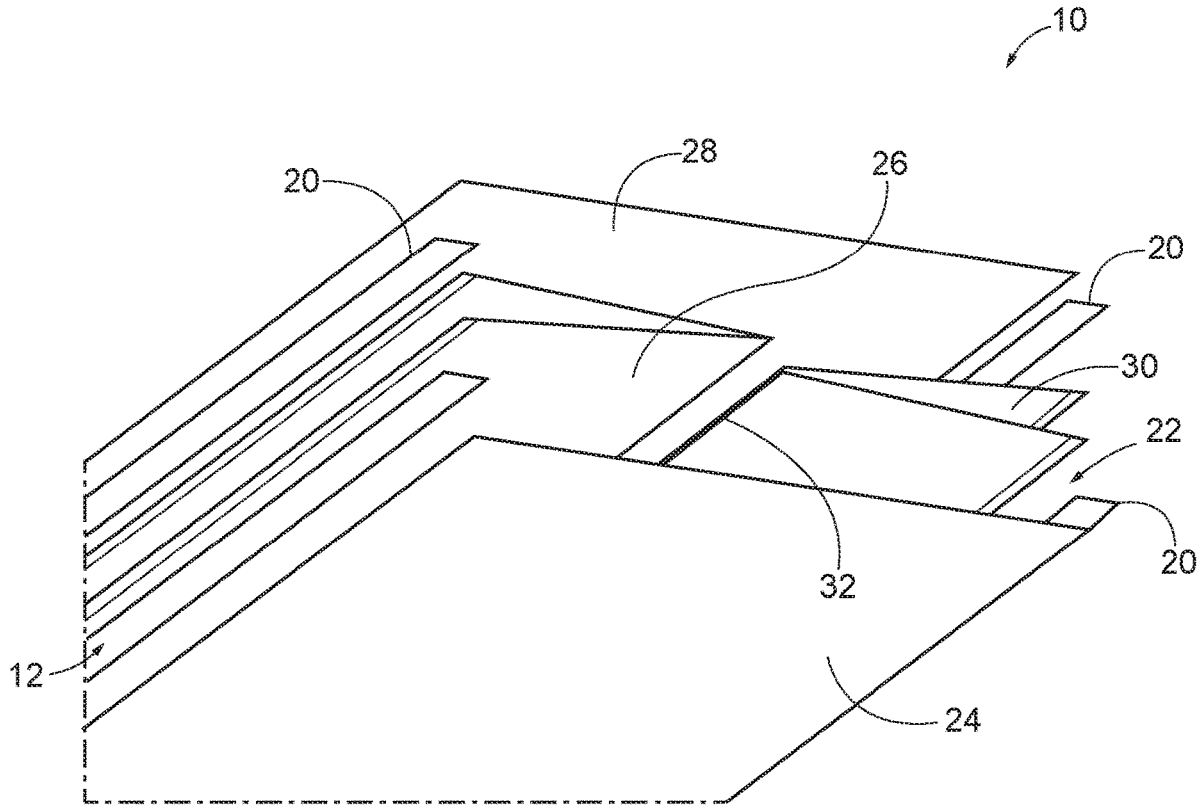
FIG. 2 illustrates an exploded view of an exemplary, non-limiting embodiment of a liner bag.

Turning to FIG. 2, an exploded view of the liner bag 10 is shown. In an embodiment, the liner bag 10 may be formed from a plurality of sheets 24, 26, 28, 30. According to an example, the plurality of sheets 24, 26, 28, 30 may be foil laminate sheets. Two sheets 26, 30 may be folded along their center 32 and may be secured to two unfolded sheets 24, 28 to create a collapsible liner bag 10. Flanges 20 (e.g., strips of polymer) may be placed between sheet 24 and sheet 30 at a location of a vertical seal 22. The vertical seal 22 may join sheet 24 and sheet 30 to the polymer flange 20. The polymer flange 20 may extend in an outward direction from the vertical seal 22 to create an anchor point to join the liner bag 10 to a FIBC, for example. The plurality of sheets 24, 26, 28, 30 may be joined to the polymer flange 20 in any suitable manner (e.g., adhesive, heat sealing, or the like).

In an embodiment, polymer flanges 20 may be secured to the exterior of the plurality of sheets 24, 26, 28, 30 at a vertical seal (e.g., vertical seal 22). The polymer flanges 20 may extend in an outward direction from the vertical seal to create an anchor point to join the liner bag 10 to a FIBC, for example. It should be appreciated that polymer flanges 20 may be secured to the plurality of sheets 24, 26, 28, 30 at any suitable location in any suitable manner to provide an anchor point for joining the liner bag 10 to a FIBC. For example, polymer flange 20 may be secured between a plurality of sheets 24,26, 28, 30, secured on top of a plurality of sheets 24,26, 28, 30, secured below a plurality of sheets 24,26, 28, 30, or any other combination of locations determined by sound engineering judgment.

Figure 3:
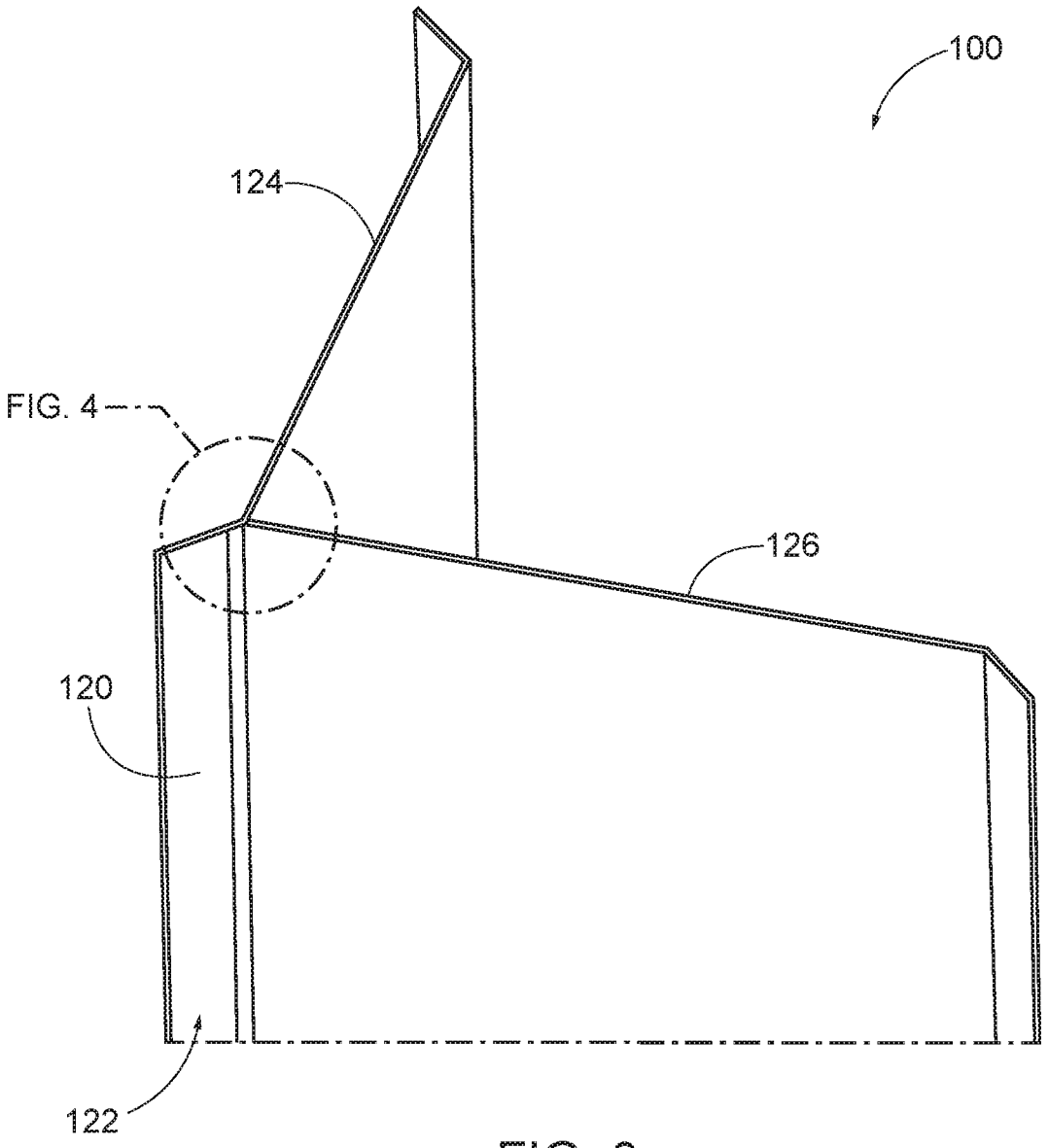
FIG. 3 illustrates an exemplary, non-limiting embodiment of foil laminate sheets.

Turning to FIG. 3, another embodiment is shown. In this embodiment, a foil laminate sheet 124, 126 may include a foil element 140 and a polymer element 150 (see FIG. 4). The foil laminate sheet 124, 126 may be manufactured to include integral flanges 120 formed by a portion of the polymer element 150 extending beyond edges of the foil element 140. The polymer flanges 120 form an anchor point to secure a liner bag 100 (formed from foil laminate sheets) to a FIBC. For instance, a plurality of foil laminate sheets 124, 126 may be secured to one another at a vertical seal 122. The vertical seal 122 may be formed at edges 142, 144 of the foil element 140 of the foil laminate sheet 124, 126 for moisture protection.

Figure 4:
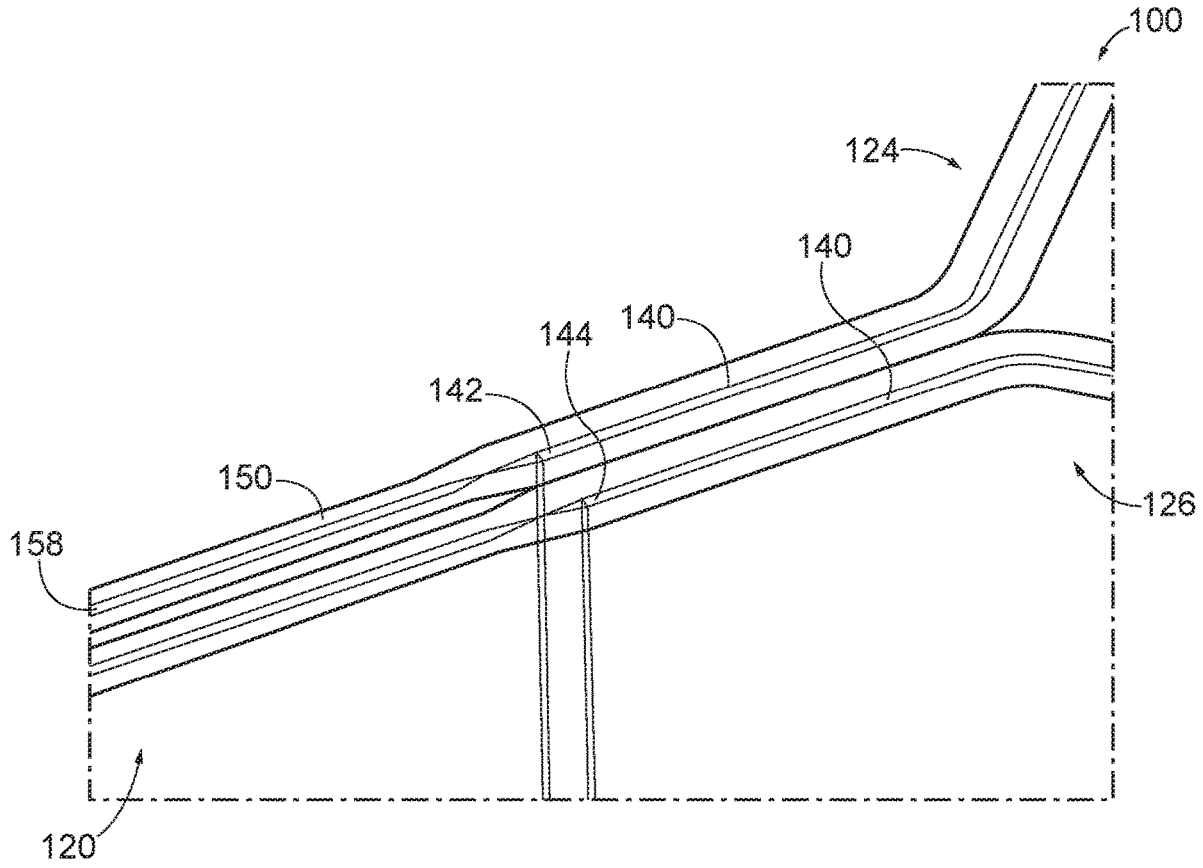
FIG. 4 illustrates a close-up view of an exemplary, non-limiting embodiment of the foil laminate sheets of FIG. 3.

Turning to FIG. 4, a close-up view of the vertical seal 122 of FIG. 3 is shown. The foil laminate sheets 124, 126 may be formed of a foil element 140 and a polymer element 150. The two elements (e.g. foil element 140 and polymer element 150) are joined such that the polymer element 150 covers or coats the foil element 140 to create a foil laminate. The foil laminate may be manufactured to form foil laminate sheets 124, 126. Flanges 120 may be integrally formed with foil laminate sheets 124, 126 by extending a portion of the polymer element 150 beyond an outer dimension of the foil element 140. In other words, a portion of the polymer element 150 is exposed (e.g. extends beyond the dimensions of the foil element 140) to create a polymer flange 120. For example, a dimension of the foil element 140 may be less than a corresponding dimension of the polymer element 150. Accordingly, when the foil element 140 is covered with or coated with the polymer element 150, an outer edge 142, 144 of the foil element 140 does not extend to an outer edge 158 of the polymer element 150.

Figure 5:
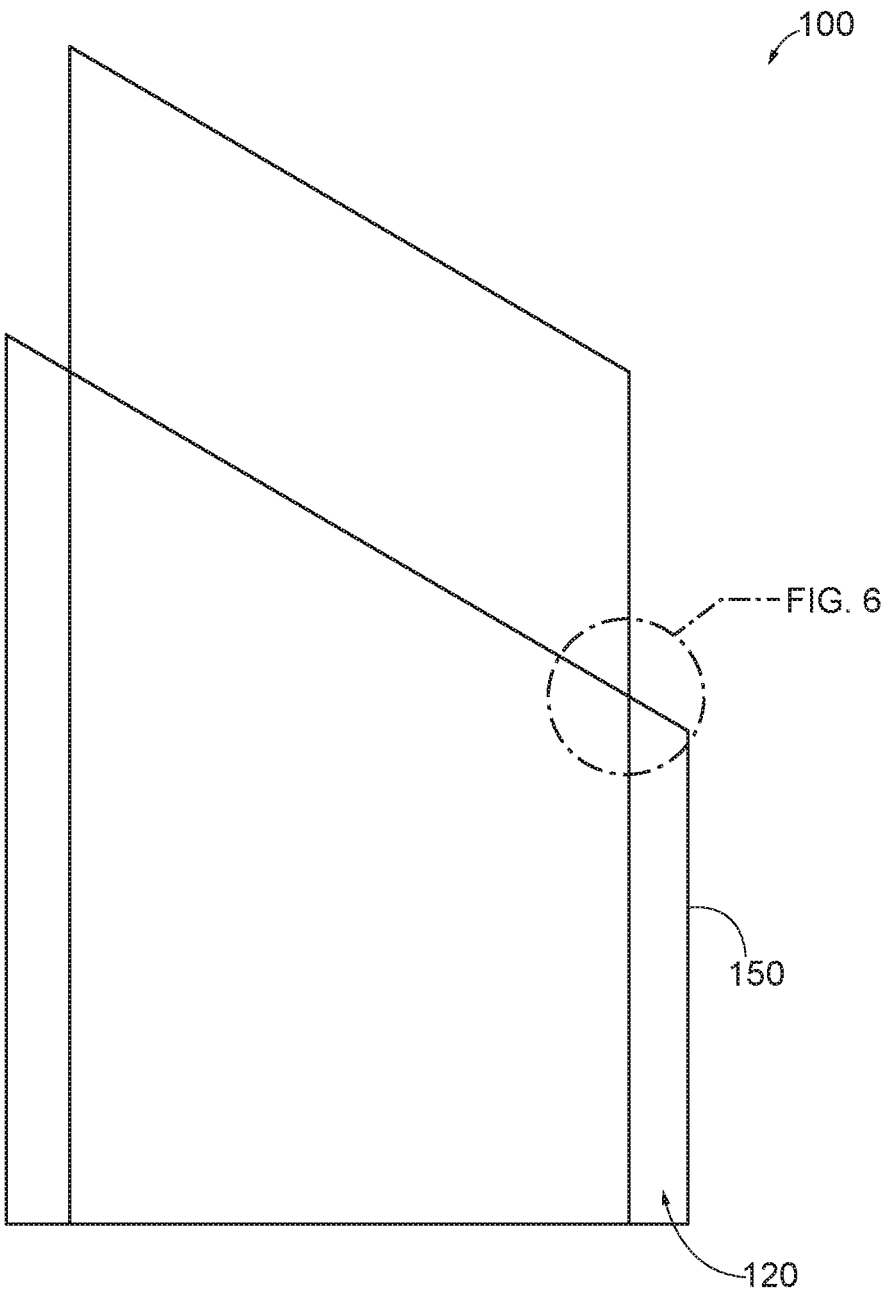
FIG. 5 illustrates an exemplary, non-limiting embodiment of a foil laminate sheet.
Figure 6:
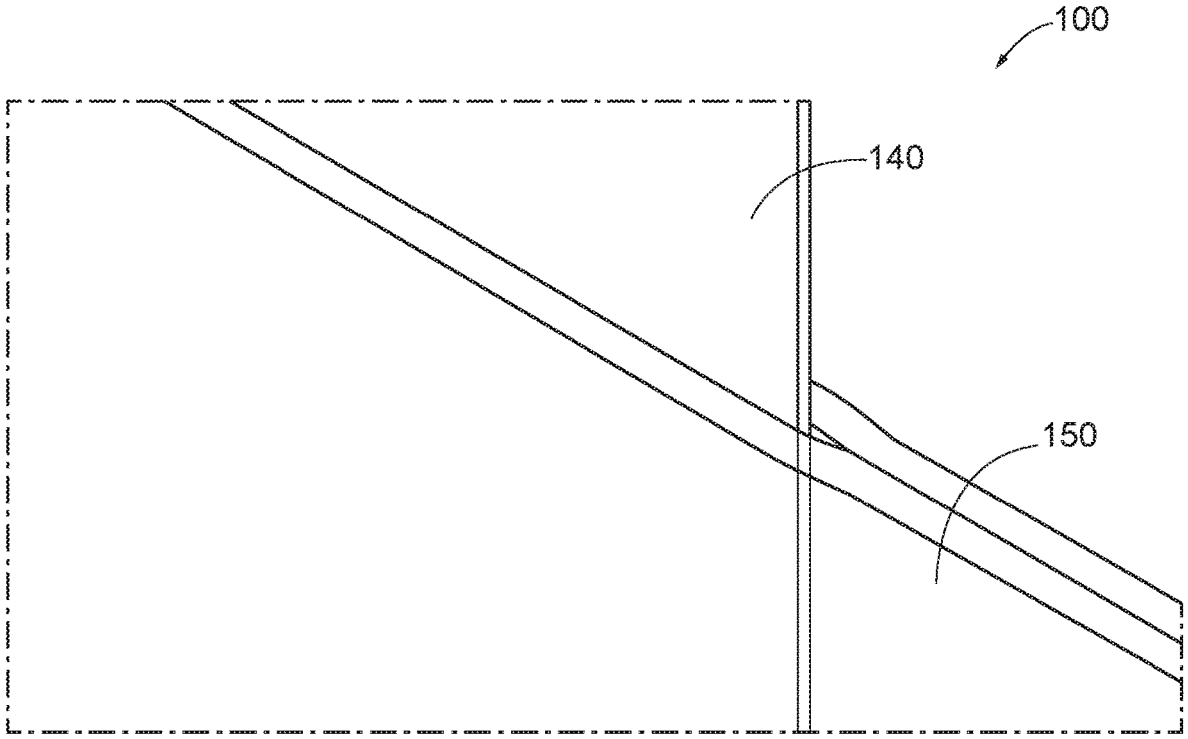
FIG. 6 illustrates a close-up view of an exemplary, non-limiting embodiment of the foil laminate sheet of FIG. 5.

Turning to FIG. 5, another embodiment of a foil laminate sheet is shown. The polymer element 150 may cover or coat the foil element 140 as shown, to form an integral polymer flange 120. A close-up of the intersection of the polymer element 150 and the foil element 140 is shown in FIG. 6.

Figure 7:
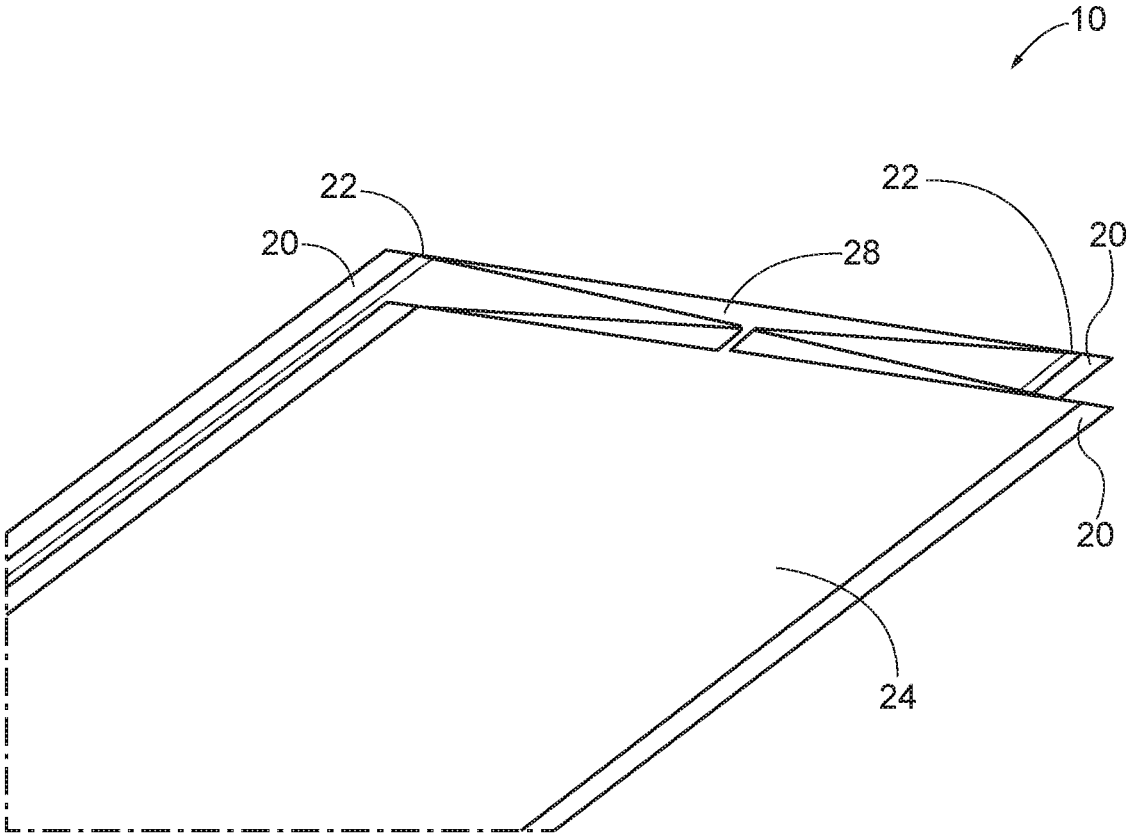
FIG. 7 illustrates an exemplary, non-limiting embodiment of a liner bag.

Turning to FIG. 7, an assembled view of the liner bag 10, 100 is shown. The liner bag 10, 100 may be assembled using any of the embodiments described herein (e.g., vertical seams 22,122). Polymer flanges 20, 120 may extend from the vertical seams 22, 122 to create anchor points along the vertical seams 22, 120 to join the liner bag 10, 100 to a FIBC. In an embodiment, the liner bag 10, 100 may be placed into and secured to a FIBC by sewing the liner bag 10, 100 to the FIBC at vertical seals 22, 122 of the FIBC. For example, the liner bag 10, 100 may be sewn to corresponding seams of the FIBC at the polymer flanges 20, 120 to secure the liner bag 10, 100 to the FIBC. Sewing through the polymer flanges 20, 120 may create a strong anchor point that is resistant to tearing at the seams (i.e., tearing at seams securing a liner bag to a FIBC).

Current construction methods may lead to tearing at the seams when puncturing the liner during sewing (e.g., caused by needle punctures of the sewing process). For example, a liner formed of foil laminate film may be susceptible to tearing (e.g., zipper tearing) at the location of punctures caused by sewing the liner to the FIBC. To solve this problem, expensive and time-consuming methods of bi-directional reinforcement tape may be used to strengthen the liner at the seams. The use of polymer flanges 20, 120, as described in the present application, offers a solution that may prevent tearing at the seams. The methods described in the present application may be less expensive and less time-consuming than current industry methods.

Figure 8:
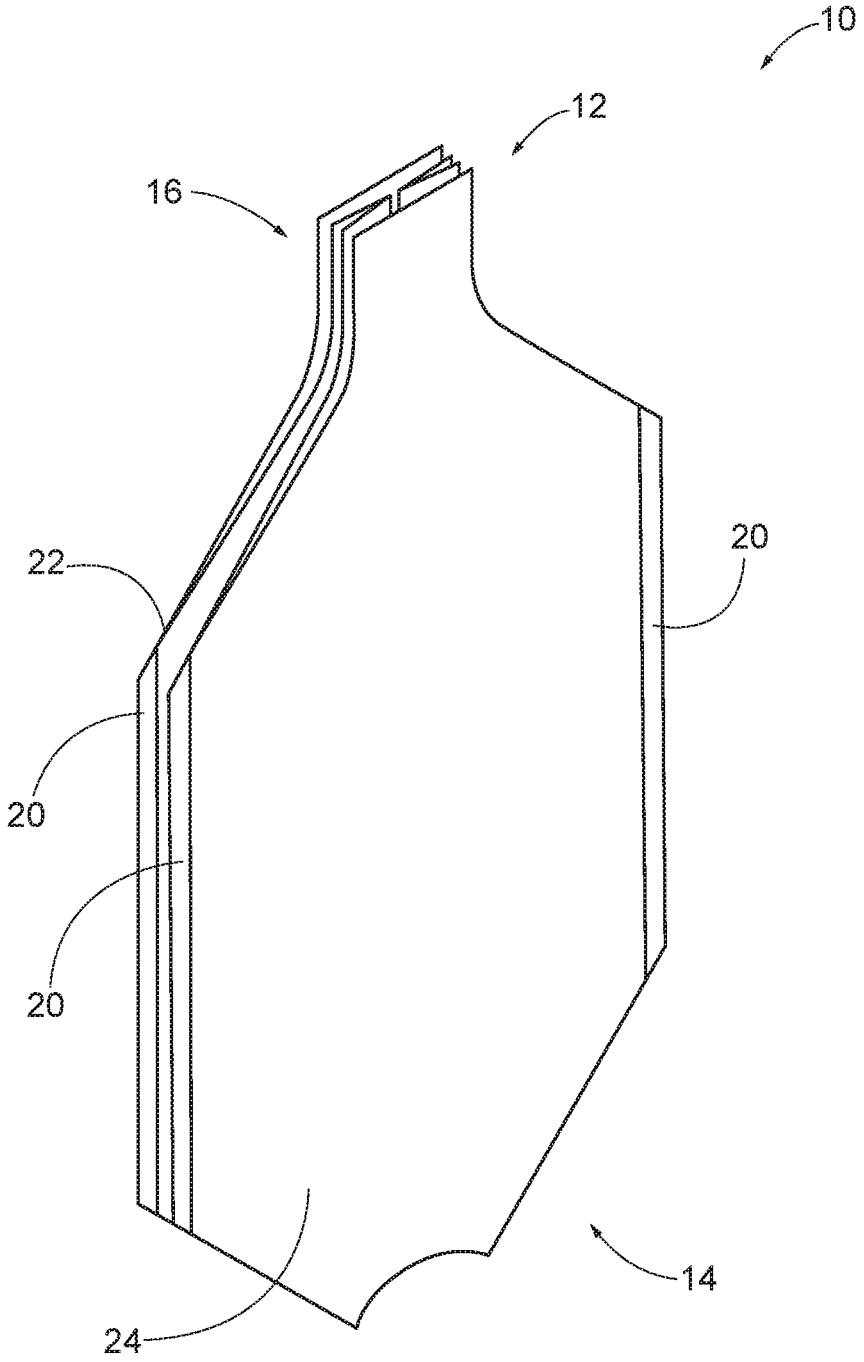
FIG. 8 illustrates an exemplary, non-limiting embodiment of a liner bag.

Turning to FIG. 8, an embodiment of the liner bag 10, 100 is shown. Polymer flanges 20, 120 may be secured to the foil laminate sheets 24, 26, 28, 30 creating a cavity 18 within the liner bag 10. Further, polymer flanges 120 may be integrally formed with the foil laminate sheets 124, 126 to create a cavity within the liner bag 100. The liner bag 10, 100 may be folded as shown in FIG. 8 to save space for storage, for example.

Various embodiments have been described herein. In one embodiment, a liner for a container comprises a body portion formed by at least two sheets, the body portion having a first end and a second end defining a cavity therebetween, the first end having an opening for receiving a product, a vertical seal joining the at least two sheets, and a flange to provide a fastening location to secure the liner to the container. The sheets may be foil laminate sheets comprising a foil element and a polymer element.

In one embodiment, the flange may be formed of a separate element that is placed between the at least two sheets to provide a fastening location to secure the liner to the container. In an example, the flange may be a strip of polymer.

In another embodiment, the sheets may be foil laminate sheets comprising a foil element and a polymer element. A portion of the polymer element may extend beyond a portion of the foil element to form a polymer flange. The polymer flange may be integrally formed with the foil laminate sheets to provide a fastening location to secure the liner to the container.

In one embodiment, a method for securing a liner to a container comprises securing a polymer flange to at least two sheets of foil laminate at a seal, joining the at least two sheets of foil laminate at a seal to create a liner for a container, wherein the polymer flange is extending outward from the liner to create a fastening location, and securing the liner to the container by sewing the liner to the container at the fastening location and at a location of the container.

In another embodiment, a method for securing a liner to a container comprises forming a flange on a foil laminate sheet at a seal, the foil laminate sheet comprising a polymer element and a foil element, joining at least two sheets of foil laminate at the seal to create a liner for a container, wherein the flange is formed by a portion of the polymer element that extends beyond an edge of the foil element to create a fastening location, and securing the liner to the container by sewing the liner to the container at the fastening location and at a location of the container.

The above examples are merely illustrative of several possible embodiments of various aspects of the present invention, wherein equivalent alterations and/or modifications will occur to others skilled in the art upon reading and understanding this specification and the annexed drawings. In particular regard to the various functions performed by the above described components (assemblies, devices, systems, circuits, and the like), the terms (including a reference to a "means") used to describe such components are intended to correspond, unless otherwise indicated, to any component, such as hardware, software, or combinations thereof, which performs the specified function of the described component (e.g., that is functionally equivalent), even though not structurally equivalent to the disclosed structure which performs the function in the illustrated implementations of the invention. In addition although a particular feature of the invention may have been disclosed with respect to only one of several implementations, such feature may be combined with one or more other features of the other implementations as may be desired and advantageous for any given or particular application. Also, to the extent that the terms "including", "includes", "having", "has", "with", or variants thereof are used in the detailed description and/or in the claims, such terms are intended to be inclusive in a manner similar to the term "comprising."

This written description uses examples to disclose the invention, including the best mode, and also to enable one of ordinary skill in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that are not different from the literal language of the claims, or if they include equivalent structural elements with insubstantial differences from the literal language of the claims.

The best mode for carrying out the invention has been described for purposes of illustrating the best mode known to the applicant at the time. The examples are illustrative only and not meant to limit the invention, as measured by the scope and merit of the claims. The invention has been described with reference to certain embodiments. Obviously, modifications and alterations will occur to others upon the reading and understanding of the specification. It is intended to include all such modifications and alterations insofar as they come within the scope of the appended claims or the equivalents thereof.

While the disclosed embodiments have been illustrated and described in considerable detail, it is not the intention to restrict or in any way limit the scope of the appended claims to such detail. It is, of course, not possible to describe every conceivable combination of components or methodologies for purposes of describing the various aspects of the subject matter. Therefore, the disclosure is not limited to the specific details or illustrative examples shown and described. Thus, this disclosure is intended to embrace alterations, modifications, and variations that fall within the scope of the appended claims, which satisfy the statutory subject matter requirements of 35 U.S.C. § 101. The above description of specific embodiments has been given by way of example. From the disclosure given, those skilled in the art will not only understand the general inventive concepts and attendant advantages, but will also find apparent various changes and modifications to the structures and methods disclosed. It is sought, therefore, to cover all such changes and modifications as fall within the spirit and scope of the general inventive concepts, as defined by the appended claims, and equivalents thereof.

What is claimed is:

1. A liner bag for a container, comprising:

a body portion formed by at least two sheets, the body portion having a first end and a second end defining a cavity therebetween, the first end having an opening for receiving a product;

at least one vertical seal joining the at least two sheets; and at least one polymer flange secured to the at least two sheets and extending outward from the at least one vertical seal to provide at least one fastening location to secure the liner bag to the container, wherein the at least one polymer flange is integral to at least one sheet of the at least two sheets, wherein each of the at least two sheets is a foil laminate sheet which includes a foil element and a polymer element, and wherein a portion of the polymer element extends beyond an edge of the foil element to create a polymer flange of the at least one polymer flange.

2. The liner bag of claim 1, wherein the at least one polymer flange is secured between the at least two sheets.

3. The liner bag of claim 1, wherein the at least one polymer flange is secured on top of or below the at least two sheets.

4. The liner bag of claim 1, wherein the at least one vertical seal extends from the first end to the second end to join the at least two sheets.

5. The liner bag of claim 1, wherein the second end is closed.

6. The liner bag of claim 1, including a closed second end, wherein at least the closed second end of the liner bag is rectangular in shape.

7. The liner bag of claim 1, wherein the liner bag is configured to fit into an interior of the container to line the container.

8. The liner bag of claim 1, including a closed second end, wherein at least the closed second end of the liner bag is circular in shape.

9. The liner bag of claim 1, including a closed second end, wherein at least the closed second end of the liner bag is polygonal in shape.

10. The liner bag of claim 1, wherein the at least one polymer flange is made of polyethylene or polypropylene material configured to resist tearing when secured to the container.

11. The liner bag of claim 1, wherein the at least two sheets include four sheets, and wherein two sheets of the four sheets are each configured to be folded along a centerline and secured to other two sheets of the four sheets to create a collapsible liner bag.

12. The liner bag of claim 1, wherein the at least two sheets and the at least one polymer flange are configured to be joined via at least one of an adhesive or heat sealing.

13. The liner bag of claim 1, wherein the polymer element includes a coating on the foil element.

14. A method for creating and securing a liner bag to a container, comprising:

joining at least two sheets of foil laminate to form a liner bag for a container, wherein each of the at least two sheets of foil laminate are comprised of a foil element and a polymer element, the at least two sheets of foil laminate having at least one polymer flange extending outward from the at least two sheets of foil laminate, wherein the at least one polymer flange is integral to at least one sheet of the at least two sheets;

forming the at least one polymer flange by extending a portion of the polymer element beyond an edge of the foil element; and sewing the liner bag to the container through the at least one polymer flange.

15. The method of claim 14, further comprising coating the polymer element onto the foil element.

16. The method of claim 14, further comprising joining the at least one polymer flange to the at least two sheets of foil laminate via at least one of heat sealing or applying an adhesive.

* * * * *